US005799633A

United States Patent [19]

Miller

[11] Patent Number: 5,799,633

[45] Date of Patent: Sep. 1, 1998

[54] ELECTRICAL INSULATOR WITH A DUCKBILL-SHAPED VALVE

[75] Inventor: John Miller, Canton, Ohio

[73] Assignee: Lexington Insulators, Jasper, Ga.

[21] Appl. No.: 908,894

[22] Filed: Aug. 8, 1997

[51] Int. Cl.[6] ..... H01R 13/52

[52] U.S. Cl. ..... 123/143 C; 123/169 PA; 439/125; 439/127

[58] Field of Search ..... 123/143 C, 169 PA, 123/169 PH; 439/125, 127, 686

[56] References Cited

U.S. PATENT DOCUMENTS

| | | | |
|---|---|---|---|
| 2,350,367 | 6/1944 | Peters et al. | 123/169 P |
| 2,724,092 | 11/1955 | Simpkins et al. | 439/125 |
| 3,716,038 | 2/1973 | Bevacqua | 123/148 A |
| 4,123,131 | 10/1978 | Pearce, Jr. et al. | 439/206 |
| 4,514,712 | 4/1985 | McDougal | 336/96 |
| 4,637,358 | 1/1987 | Yano et al. | 123/169 PA |
| 4,671,586 | 6/1987 | DeBolt | 439/126 |
| 4,906,202 | 3/1990 | Germ | 439/127 |
| 5,145,433 | 9/1992 | Yagi et al. | 445/7 |
| 5,377,640 | 1/1995 | Kobayashi | 123/143 C |
| 5,462,023 | 10/1995 | Furuya | 123/143 C |
| 5,549,082 | 8/1996 | Kobayashi | 123/143 C |
| 5,592,911 | 1/1997 | Komatsu | 123/143 C |
| 5,618,193 | 4/1997 | Nakajima et al. | 439/125 |
| 5,662,095 | 9/1997 | Matsuo | 123/143 C |

*Primary Examiner*—Tony M. Argenbright
*Assistant Examiner*—Hieu T. Vo
*Attorney, Agent, or Firm*—Nixon, Hargrave, Devans & Doyle LLP

[57] ABSTRACT

An electrical insulator in accordance with the present invention includes a body, a ventilation passage, a bore, and a duckbill-shaped valve. The ventilation passage which extends between a first opening and a second opening in the body. The bore also extends through the body and is spaced from the ventilation passage. The duckbill-shaped valve comprises at least two walls. The walls are connected on opposing sides of the second opening and at an angle with respect to the body and each other so that the walls engage each other and define a space above the second opening and below the walls. A slit is formed between the walls. The portion of the walls at the slit normally remain in contact with each other until a cracking pressure is reached.

20 Claims, 4 Drawing Sheets

ELECTRICAL INSULATOR WITH A DUCKBILL-SHAPED VALVE

FIELD OF THE INVENTION

The present invention relates generally to an electrical insulator and, more particularly, to a spark plug boot with a duckbill-shaped valve.

BACKGROUND OF THE INVENTION

One example of an electrical insulator is a spark plug boot. Typically, a spark plug boot has an elongated bore which extends along the length of the boot. A connector, such as an ignition cable, extends from one end of the boot towards the other end of the boot. When the boot is inserted in a spark plug well, a seal adjacent one end of the boot seals with the top of the well. The other end of the boot fits over a spark plug located in the base of the well coupling the spark plug boot to the connector.

One problem that spark plug boots encounter, such as the one described above, is with the buildup of gases inside the bore near where the spark plug boot connects with the spark plug and also outside of the bore between the boot and the spark plug well. In either case, the buildup of gases in the bore and/or the spark plug well can cause the spark plug to disconnect from the connector in the spark plug boot and the spark plug boot to partially dislodge from the spark plug well.

To release the buildup of gases in the bore and in the spark plug well, a variety of different types of vents have been designed for spark plug boots. Although these prior vents are generally successful in releasing the built up gasses, the vents introduce a new problem. The vents permit moisture and/or dirt to enter the bore and/or the spark plug well which can corrode connections in the spark plug well. As discussed in greater detail below, attempts have been made to permit venting while still preventing the ingress of moisture and dirt, but they have had limited success.

One prior solution is disclosed in U.S. Pat. No. 5,592,911 to Komatsu, which is herein incorporated by reference. Komatsu discloses a plug cap with a cable opening for an ignition cable and a vent which is adjacent to, but spaced from the cable opening. The vent provides a passage to release air in the spark plug well. A flap is pivotally secured in an open position at the upper end of the vent. The flap closes the vent when it is subjected to the impact of water drops. Unfortunately, since the flap is normally open, it is possible for some moisture, such as humidity, and also some dirt to get into the spark plug well and cause corrosion problems.

Another prior solution is disclosed in U.S. Pat. No. 4,514,712 to McDougal, which is herein incorporated by reference. McDougal discloses a boot with a threaded bore for engagement with one end of a spark plug and a vent passage extending from the top of the boot down to the elongated bore. The vent passage provides a path for air in the bore, as opposed to the spark plug well, to escape. The top of the vent passage includes an enlarged portion which holds a filter material which is designed to prevent dirt or water from getting in to the bore. Although this vent system works, it is possible that moisture may still seep past the filter and corrode the connection below. Additionally, the enlargement of the portion of the vent passage to receive the filter and the installation of the filter add additional manufacturing steps which add to the overall cost of the spark plug boot.

Another prior solution is disclosed in U.S. Pat. No. 5,549,082 to Kobayashi, which is herein incorporated by reference. Kobayashi discloses a plug cap with a vent channel that extends from the top of the cap down into the spark plug well. The vent channel provides a passage to release air in the spark plug well. The top portion of the vent channel has a smaller diameter then the rest of the vent channel. A sealing member is movably inserted into the top portion of the vent channel. The sealing member includes a pair of valve portions with a larger diameter than the top portion of the vent channel. The valve portions are separated by a shaft which has a smaller diameter than the top portion of the vent channel. The sealing member also includes a vent which connects the vent channel to the atmosphere when the sealing member is moved up as a result of the buildup of pressure in the spark plug well. The sealing member helps to keep moisture out of the spark plug well. Although this solution works, the manufacture and installation of the sealing member is difficult, involving a number of steps, which all add to the overall cost of the spark plug boot.

Yet, another prior solution is disclosed in U.S. Pat. No. 2,724,092 to Simpkins, which is herein incorporated by reference. Simpkins discloses an insulated terminal with a conductor receiving leg and an electrode receiving leg. A pressure relief hole is pierced sideways or horizontally into the insulated terminal and extends all the way in to the spark plug electrode in the electrode receiving leg. The pressure relief hole allows air to escape out from the electrode receiving leg, as opposed to the spark plug well. Although this solution works, it only addresses the problem of pressure buildup in the electrode receiving leg. If the insulated terminal disclosed in Simpkins was placed in a spark plug well, the pressure relief hole which extends substantially perpendicular to the electrode receiving leg would simply be releasing air in the electrode receiving leg into the spark plug well. The pressure relief hole does not address the problem of air building up in the spark plug well. Additionally, since the pressure relief hole is simply a pierced opening through the side of the electrode receiving leg, the pressure relief hole is a two-way valve. As a result, the pressure relief hole could be forced to open and allow water and/or dirt to enter into the electrode receiving leg and corrode internal connections.

SUMMARY OF THE INVENTION

An electrical insulator in accordance with the present invention includes a body, a ventilation passage, a bore, and a duckbill-shaped valve. The ventilation passage which extends between a first opening and a second opening in the body. The bore also extends through the body and is spaced from the ventilation passage. The duckbill-shaped valve comprises at least two walls which are connected on opposing sides of the second opening and at an angle with respect to the body and each other so that the walls engage each other and define a sealed space above the second opening and below the walls. A slit is formed between the walls. The portion of the walls at the slit normally remain in contact with each other until a cracking pressure is reached.

The electrical insulator in accordance with the present invention provides a number of advantages. For example, the insulator provides an effective system for releasing the buildup of gases in the spark plug well, without permitting moisture and/or dirt from getting into the spark plug well. Additionally, when compared with prior solutions, the present invention requires fewer and less complicated manufacturing steps and thus is less expensive to manufacture. Further, the duckbill-shaped valve can be easily modified to open at a variety of different internal cracking pressures depending upon the particular application.

DETAILED DESCRIPTION

Figure 1A:
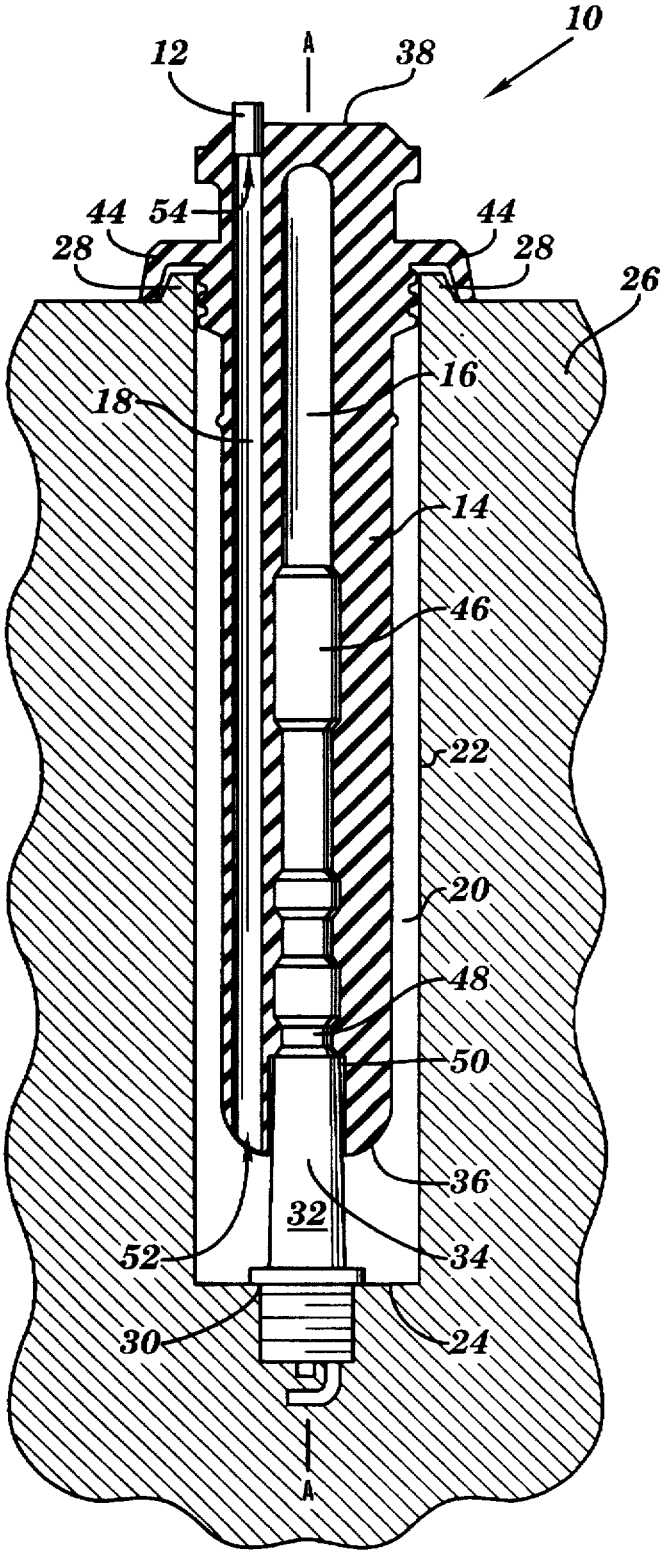
FIG. 1A is a cross-sectional view of one embodiment of a spark plug boot in accordance with the present invention in a spark plug well.

A spark plug boot 10 with the "duckbill-shaped" valve 12 in accordance with the present invention is illustrated in FIGS. 1A, 2A–2D, and 3A–3C. The spark plug boot 10 includes a body 14, a bore 16, a ventilation passage 18, and the valve 12. The spark plug boot 10 provides several advantages including providing an effective system for releasing the buildup of gases in a spark plug well 20, without permitting moisture and/or dirt from getting into the spark plug well 20.

Figure 1B:
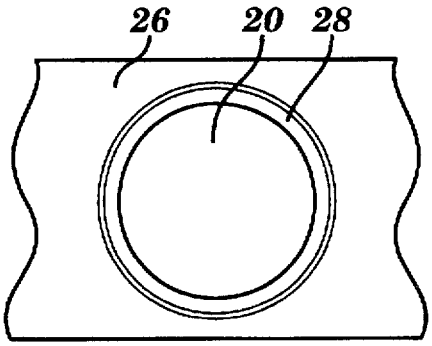
FIG. 1B is a top view of the spark plug well.

Referring more specifically to FIGS. 1A and 1B, the spark plug boot 10 is adapted to fit in a spark plug well 20. The spark plug well 20 is an elongated opening with at least one side wall 22 and a base 24 which is formed in an engine block 26. In this particular embodiment, the spark plug well 20 has a substantially circular cross-sectional shape, although the spark plug well 20 could have other cross-sectional shapes, if needed or desired. Additionally, in this particular embodiment, a rim 28 is formed on the engine block 26 adjacent to and around the spark plug well 20. The base 24 of the spark plug well 20 has an opening 30 which is adapted to receive a spark plug 32. When the spark plug 32 is secured in the opening, a terminal end 34 of the spark plug 32 extends into the opening 30, but below the top of the spark plug well 20.

Figure 2A:
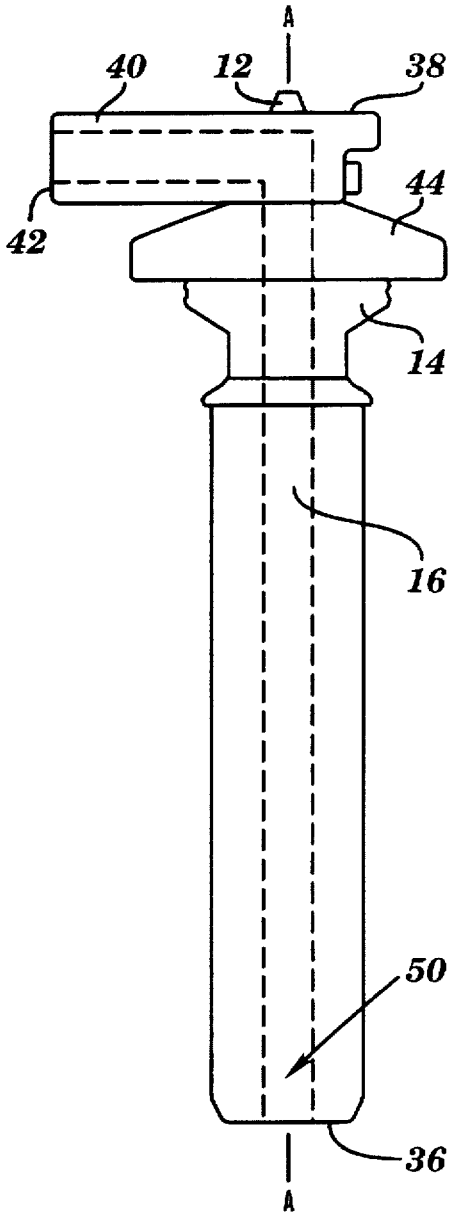
FIG. 2A is a side view of the spark plug boot.

Referring to FIGS. 1A and 2A, the body 14 of the spark plug boot 10 has first and second ends 36 and 38. A portion of the body 14 of the spark plug boot 10 extends along a first axis A—A. In this particular embodiment, the body 14 has a section 40 adjacent the second end 38 which extends away from the body 14 towards a third end 42. In this particular embodiment, this section 40 is integrally formed with the body 14, although the section 40 could be formed separately and then mounted on the body 14. The body 14 may be manufactured from a variety of different types of materials, such as rubber or plastic.

The body 14 also has a seal 44 located on the same side of the body 14 as the second end 38 which extends around the body 14. In this particular embodiment, the seal 44 extends out substantially perpendicular from the body 14 adjacent the second end 38 and then extends down to have a substantially L-shape. Although one type and shape of seal 44 is shown, the type and shape of the seal 44 can vary as needed or desired. When the spark plug boot 10 is seated in the spark plug well 20, the seal 44 seals off the top of the spark plug well 20. More specifically, in this particular embodiment, the seal 44 is seated over the outside edge of the rim 28 formed on the engine block 26 as shown in FIG. 1A.

Figure 2B:
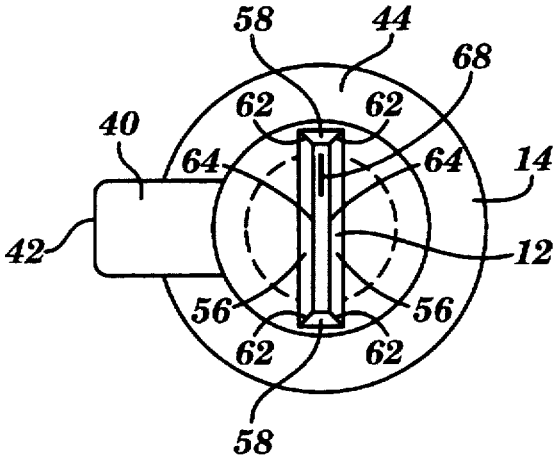
FIG. 2B is a top view of the spark plug boot shown in FIG. 2A.
Figure 2C:
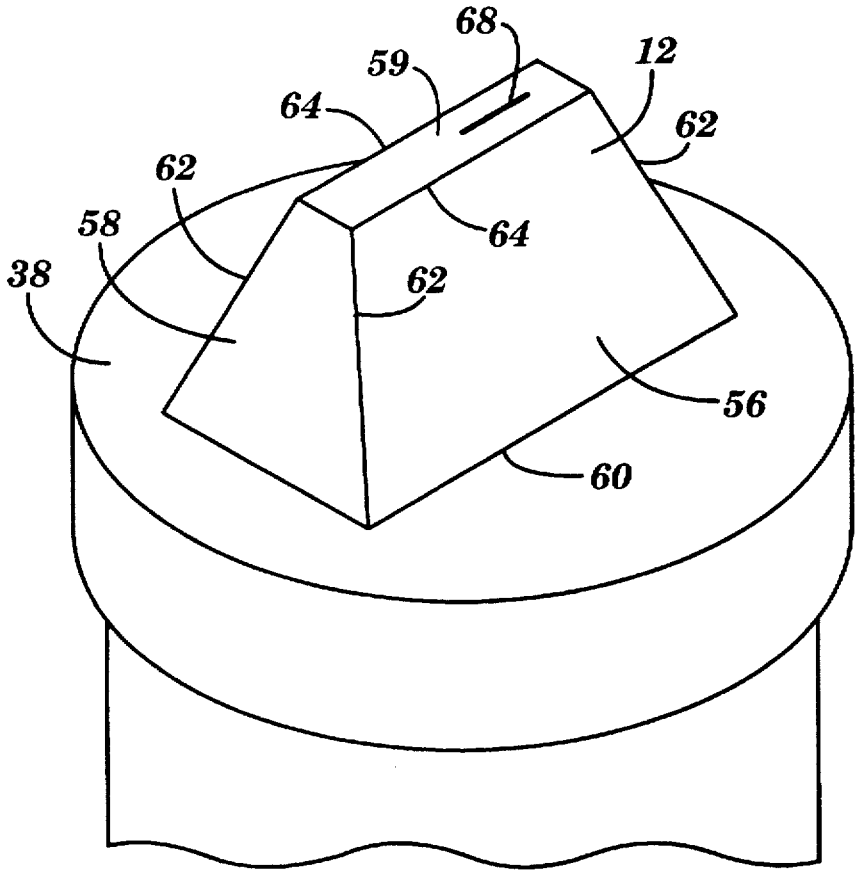
FIG. 2C is a perspective of the vent on the top of the spark plug boot.
Figure 2D:
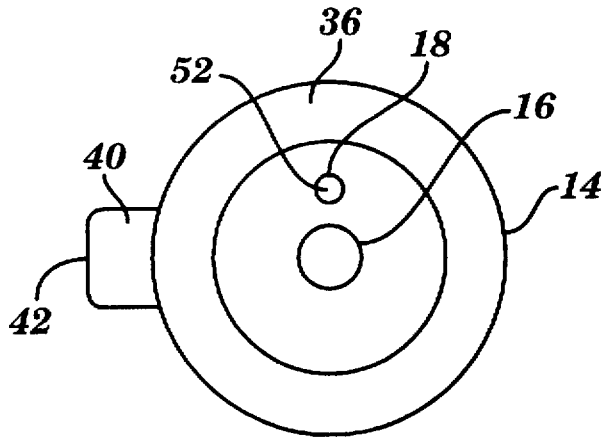
FIG. 2D is a bottom view of the spark plug boot shown in FIG. 1A.

Referring to FIGS. 1A, 2A, and 2D, the bore 16 extends from the first end 36 of the body 14 to and out the third end 42 in section 40 of body 14. A portion of the bore 16 extends along the axis A—A. Although bore 16 extends between first and third ends 36 and 42, bore 16 could extend in other directions, such as between first and second ends 36 and 38. In this particular embodiment, the bore 16 has a substantially circular cross-sectional area, although the shape of the bore 16 can vary as needed or desired (For ease of illustration, the bore 16 shown in phantom in FIG. 2A is illustrated as having a uniform diameter throughout, but in fact has a shape as illustrated in FIG. 1A with changing diameters).

A conductor 46, such as an ignition cable, extends in from the third end 42 towards the first end 36. The end of the conductor 46 near the first end 36 has a connector 48 adapted to couple with the terminal end 34 of spark plug 32. The connector 48 in the bore 16 is spaced from the first end 36 to define a region 50. The region 50 is adapted to receive the terminal end 34 of the spark plug 32. As discussed in greater detail earlier, gases can buildup in this region 50 causing the terminal end 34 of the spark plug 32 to disconnect from the connector 48.

The ventilation passage 18 is formed in the body 14 and extends between a first opening 52 at the first end 36 and a second opening 54 at the second end 38 and is spaced from the bore 16. In this particular embodiment, the ventilation passage 18 is substantially parallel to the axis A—A and has a substantially circular cross-sectional shape with a diameter ranging between 1.0 mm and 1.5 mm, although the ventilation passage 18 does not need to be substantially parallel to the axis A-A and could have other cross-sectional shapes and diameter ranges, as needed or desired. The ventilation passage 18 permits gases building up in the spark plug well 20 to escape via the second opening 54 so that the spark plug boot 10 does not partially dislodge from the spark plug well 10 and the terminal end 34 of spark plug 32 does not disconnect from the connector 48.

Referring to FIGS. 1A, 2A–2C, and 3A–3C, the valve 12 is a structure which defines a sealed or enclosed space 66 above the second opening 54 of ventilation passage 18. The valve 12 is connected to body 14 and has a slit or opening 68 which extends through the structure connecting the space 66 to the atmosphere. The slit 68 is normally closed and can only be opened due to the build up on internal pressure in space 66, ventilation passage 18, and/or spark plug well 20. As a result, valve 12 is a one-way valve. External gases, water, dirt, etc. can not pass through the valve 12 into the spark plug well 20 to corrode internal connections. Although in this particular embodiment, the valve 12 is integrally formed with the spark plug boot 10, the valve 12 could be made separately and then could be mounted on the body 14 if needed or desired. A variety of different types of materials could be used to form the valve 12, such as rubber or plastic.

Figure 3A:
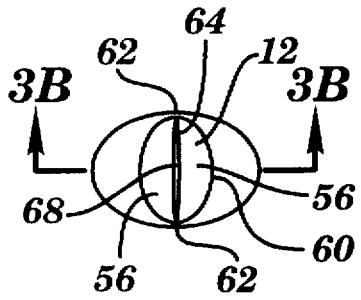
FIG. 3A is a top view of another embodiment of the vent on the top of the spark plug boot.
Figure 3B:
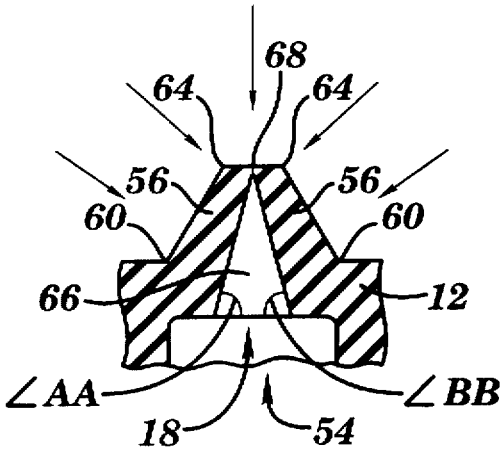
FIG. 3B is a cross-sectional view of the vent shown in FIG. 3A taken along line 3B—3B in a normally closed position.
Figure 3C:
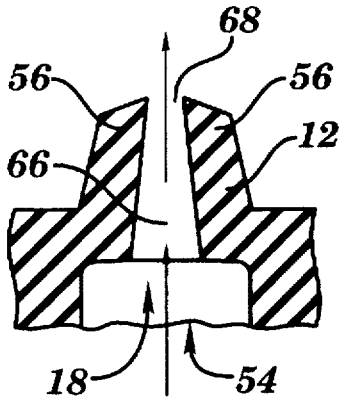
FIG. 3C is a cross-sectional view of the vent shown in FIG. 3A in an open position.

Referring to FIGS. 3A–3C, one embodiment of the valve 12 is illustrated. In this particular embodiment, the valve 12 includes two walls 56 which are secured to opposing sides of the second opening 54 of the ventilation passage 18 and are integrally formed together. The walls 56 define the sealed or enclosed space 66 located over the second opening 54 of body 14. Each wall 56 has a base 60, sides 62 and a top 64. In this particular embodiment, each wall 56 has a thickness ranging between 1.0 mm and 2.0 mm, although the walls 56 can have other thicknesses, as needed or desired. The thickness of the walls 56 can be varied to control the cracking pressure when the valve 12 will open at slit 68.

Referring to FIG. 3A, the base 60 of each wall 56 is connected to the second end 38 of the body 14 around the second opening 54 at an angle AA or an angle BB with respect to the second end 38 in space 66 so that the walls 56 extend towards and engage each other at their tops 64 where the walls 56 are integrally formed together. In this particular embodiment, angles AA and BB are the same and range between thirty degrees and seventy degrees included, although the angles AA and BB can be different and can have different ranges, if needed or desired.

The slit or opening 68 is formed between the tops 64 of walls 56. In this particular embodiment, the slit 68 ranges between 3.0 mm and 3.5 mm. The size of slit 68 can be varied to control the cracking pressure when the valve 12 will open at slit 68.

As illustrated in FIGS. 3A–3C, the valve 12 has a duckbill or substantially-triangular shape. In this particular embodiment, the valve 12 is formed as one-piece (so the walls 56 are integrally formed together) and the valve 12 is formed as one piece with the body 14, although the walls 56 of valve 12 could be formed separately and then connected together and/or the valve 12 could be formed as one piece and then could be connected to the body 14, if needed or desired.

Although only two walls 56 are shown in FIGS. 3A–3C, the valve 12 can have other configurations. For example, FIGS. 2B and 2C illustrate another embodiment of valve 12. In this embodiment, the valve 12 has a structure with two walls 56 which are mounted at an angle AA and BB as described earlier and two walls 58 which are located on opposing sides of and connect the sides 62 of walls 56 together to define the seal or enclosed space 66. The tops 64 of walls 56 are integrally joined together at a region 59. In this particular embodiment, the walls 56 and 58 are integrally formed together and are integrally formed with the body 14, although the walls 56 and 58 could be formed separately and then joined together and/or the valve 12 could be formed as one piece and then could be mounted on body 14.

The slit 68 is located in region 59 at the tops 64 of walls 56. As discussed above, the thickness of the walls 56 and 58 along with the size of slit 68 to control the cracking pressure when normally closed valve 12 will open at slit 68.

The spark plug boot 10 with valve 12 is easier and less expensive to manufacture then prior systems, because it can be integrally formed as one piece in a molding operation. Once the spark plug boot 10 with the valve 12 is formed, the only additional step required is to pierce the slit 68 between walls 56, which can be done easily and inexpensively.

The operation of the spark plug boot 10 with the valve 12 will be illustrated with reference to FIGS. 1A, 3B, and 3C. The spark plug boot 10 is inserted in the spark plug well 20 until the terminal end 34 of the spark plug 32 is seated in the first end 36 of the spark plug boot 10 and is coupled to the connector 48 in the bore 16 and until the seal 44 adjacent the second end 38 of the spark plug boot 10 is seated over the rim 28 to seal the spark plug well 20. Once the spark plug boot 10 is in place, the engine can be started.

Valve 12 remains closed until an internal cracking pressure is reached. As a result, moisture and dirt are prevented from entering the spark plug well 20 via second opening 54 for ventilation passage 18. In fact as illustrated in FIG. 3B, external pressure to try and force the valve 12 open actually pushes the angled walls 56 of the valve 12 against each other creating an even tighter seal.

When the internal cracking pressure is finally reached, one-way valve 12 opens forcing walls 56 at slit 68 apart, as illustrated in FIG. 3C. When the valve 12 is open, gases in the spark plug well 20 pass up ventilation passage 18, through space 66 and out from valve 12 to the atmosphere. Since gases can dissipate when they buildup in the spark plug well 20, the spark plug boot 10 remains seated on the engine block 26 and the terminal end 34 of the spark plug 32 remains coupled to the connector 48 in the spark plug boot 10.

One feature of the invention is that a range of cracking pressures and flow rates can be designed into the valve 12 by simply varying the thickness of the walls 56 and/or the length of the slit 68, which was not possible with prior designs. In this particular embodiment, the valve 12 is designed to have a cracking pressure starting between 1.0 to 15.0 psi+/–0.5 psi and a flow rate ranging between 0.1 to 5.0 cfm.

Having thus described the basic concept of the invention, it will be readily apparent to those skilled in the art that the foregoing detailed disclosure is intended to be presented by way of example only, and is not limiting. Various alterations, improvements and modifications will occur and are intended to those skilled in the art, though not expressly stated herein. These modifications, alterations and improvements are intended to be suggested hereby, and are within the spirit and scope of the invention. Accordingly, the invention is limited only by the following claims and equivalents thereto.

What is claimed is:

1. A spark plug boot comprising:

a body;

a ventilation passage which extends between a first opening and a second opening in the body; and a one-way valve which comprises at least two walls, the walls being connected on opposing sides of the second opening and at an angle with respect to body and each other so that the walls engage each other and define a sealed space above the second opening and below the walls and a slit formed between the walls, the walls normally remain in contact with each other at the slit until a cracking pressure is reached where the walls at the slit begin to separate.

2. The spark plug boot as set forth in claim 1 wherein the walls are connected to the body to form a substantially duckbill shape.

3. The spark plug boot as set forth in claim 1 wherein the included angle of each of the walls with respect to the second opening ranges between thirty degrees and seventy degrees.

4. The spark plug boot as set forth in claim 1 wherein the starting cracking pressure ranges between 1.0 to 15.0 psi.

5. The spark plug boot as set forth in claim 1 wherein the one-way valve is integrally formed with the body.

6. The spark plug boot as set forth in claim 1 further comprising a seal formed on the same end of the body as the second opening.

7. The spark plug boot as set forth in claim 1 further comprising a bore which extends through the body, the bore being spaced from the ventilation passage.

8. An electrical insulator comprising:

a body;

a bore which extends through the body;

a ventilation passage which extends between a first opening and a second opening in the body, the ventilation passage being spaced from the bore;

a structure located over the second opening, the structure defining a sealed space above the second opening; and a slit extending through the structure to the sealed space, wherein the slit in the structure is normally closed and the structure is a one-way valve.

9. The electrical insulator as set forth in claim 8 wherein the structure has a duckbill-shape.

10. The electrical insulator as set forth in claim 9 wherein the structure has a starting cracking pressure where the slit starts to open ranging between 1.0 to 15.0 psi.

11. The electrical insulator as set forth in claim 8 wherein the structure is integrally formed with the body.

12. The electrical insulator as set forth in claim 8 further comprising a seal formed on the same end of the body as the second opening.

13. An internal combustion engine comprising:

an engine block with at least one spark plug well, the spark plug well having at least one side wall and a base;

a spark plug with a terminal end, the spark plug seated in the base so that the terminal end extends into the spark plug well;

a body, with at least a portion of the body located in the spark plug well;

a bore which extends through the body, one end of the bore being detachably seated over the terminal end of the spark plug in the base of the spark plug well;

a ventilation passage which extends between a first opening and a second opening in the body, the first opening being located in the spark plug well;

a structure located over the second opening, the structure defining a sealed space above the second opening; and a slit extending through the structure to the sealed space, wherein the slit in the structure is normally closed and the structure is a one-way valve.

14. The internal combustion engine as set forth in claim 13 wherein the structure has a duckbill-shape.

15. The internal combustion engine as set forth in claim 13 wherein the structure comprises at least two walls, the walls being connected on opposing sides of the second opening and at an angle with respect to body and each other so that the walls engage each other and define the sealed space above the second opening and below the walls, wherein the slit is formed between the walls.

16. The internal combustion engine as set forth in claim 15 wherein the included angle of each of the walls with respect to the second opening ranges between thirty degrees and seventy degrees.

17. The internal combustion engine as set forth in claim 15 wherein the structure comprises four walls.

18. The internal combustion engine as set forth in claim 13 wherein the structure has a starting cracking pressure where the slit starts to open ranging between 1.0 to 15.0 psi.

19. The internal combustion engine as set forth in claim 13 wherein the structure is integrally formed with the body.

20. The internal combustion engine as set forth in claim 13 further comprising:

a sealing rim formed on the engine block around the second opening; and a substantially L-shaped structure which is connected to the body on the same as the second opening and extends out substantially perpendicular to the body, the structure detachably engaged with the sealing rim to seal the spark plug well.

* * * * *